United States Patent [19]

Tharp

[11] Patent Number: 4,537,556

[45] Date of Patent: Aug. 27, 1985

[54] RECIPROCATING BACKHOE BUCKET

[76] Inventor: Emery C. Tharp, 2520 Fox Harbor Dr., Indianapolis, Ind. 46227

[21] Appl. No.: 493,921

[22] Filed: May 12, 1983

[51] Int. Cl.[3] ..... B66C 23/00

[52] U.S. Cl. ..... 414/725

[58] Field of Search ..... 414/722, 725; 172/40; 37/103, DIG. 18

[56] References Cited

U.S. PATENT DOCUMENTS 4,444,542 4/1984 Shaw et al. ..... 414/722 X

FOREIGN PATENT DOCUMENTS 2508046 9/1975 Fed. Rep. of Germany ..... 414/722

55-4468 1/1980 Japan ..... 37/DIG. 18

*Primary Examiner*—Joseph E. Valenza

*Assistant Examiner*—Dennis Williamson

*Attorney, Agent, or Firm*—Leonard Bloom

[57] ABSTRACT

A reciprocating adjunct for conventional backhoe buckets including a shaft which is supported on bearings and carried on connecting links depending from a bucket curl mechanism which is supported by transverse links extending to a dipper stick associated with conventional backhoe buckets, the shaft including termini having cam surfaces communicating with bearings supporting bucket brackets providing with the dipper stick the sole supports for the bucket whereby rotation of the shaft and therefor the associated cam surfaces causes a reciprocating oscillating motion of the bucket.

3 Claims, 3 Drawing Figures

RECIPROCATING BACKHOE BUCKET

BACKGROUND OF THE INVENTION

The following invention relates generally to an apparatus for providing a reciprocating action on a bucket of a backhoe or the like.

Frequently in the construction industry it is required that the machinery associated with and deployed upon a construction site be utilized to some extent beyond the power rating of the machinery. When this occurs, breakdown of the machinery or premature wear can occur, in which the hydraulic motor associated with the power unit can be overloaded and bogged down or alternatively, hydraulic lines associated therewith can break.

Since in many instances, the power rating of construction equipment determines the severity of jobs for which the machine is eligible, it stands to reason that construction devices which have been augmented to provide a greater work output when compared with comparably dimensioned machines provides a substantial advantage in the field.

The following citations reflect the state of the art of which applicant is aware insofar as these citations appear germane to the process at hand.

U.S. Pat. No. Re. 206,663, Cameron
U.S. Pat. No. 954,758, Naylor
U.S. Pat. No. 1,632,345, Muelhause
U.S. Pat. No. 3,238,646, Odenburg
U.S. Pat. No. 3,328,904, Voight et al
U.S. Pat. No. 3,410,352, Tharp
U.S. Pat. No. 3,628,265, Galis
U.S. Pat. No. 3,762,481, Allen et al
U.S. Pat. No. 3,952,810, Ulrich
U.S. Pat. No. 4,102,402, Steinberg
U.S. Pat. No. 4,082,149, Grobey
U.S. Pat. No. 4,098,344, Johnson The patent to Voight et al teaches the use of a powered bucket and includes a means for having the bucket teeth 14, 16, 18 and 20 move in a geneally reciprocating manner and therefore includes a drive motor 28 adapted to drive the teeth by virtue of a chain mechanism. FIG. 3 shows a sectional view of one of the eccentrics 39 which provides the receiprocation of the teeth. As is clearly illustrated in the drawings, the mechanisms providing reciprocating vibratory motion of the bucket teeth do so at the expense of the available space within the bucket, thereby reducing its payload, although it does appear to allow greater forces to be applied through the powered bucket itself.

Similarly, Odenburg teaches the use of a motorized bucket in which the vibrating blade includes a roller bearing assembly 22 pivotally mounted on a strap portion of a lever 23 on an eccentric. A stub shaft 24 pivotally mounts a pair of arms 25 of a bellcrank assembly 16 disposed on lever 23. Thus, motion of shaft 18 provides a blade which vibrates. It would appear that the Odenburg structure is limited to providing the cutting edge to vibrate exclusive of the remainder of the bucket, and while this may have value when loading the bucket by gouging into hard-packed clay or the like, it does nothing to help remove the densely packed clay or other material from the bucket when the bucket is to be emptied.

The remaining citations show the state of the art further.

Thus, while it is clear that the use of motorized buckets having vibrator blades actuated in part by cams is known, the prior art listed and discussed herein above are limited by engineering difficulties to which the instant application provides beneficial response.

More particularly, while the prior art exemplifies techniques which either cause a portion of the bucket and more particularly the working or cutting edge to vibrate, it only does so at the expense of available payload capability of the motorized bucket, particularly when contrasted with the instant invention.

Thus, a long felt but heretofor unsatisfied need exists for providing a device as defined by the instant application which allows the entire motorized bucket to vibrate at a rapid rate and effect the efficiency of the bucket whether the motorized bucket is to be used for loading or unloading material or for scraping.

Such distinctions are possible by the structure of the reciprocating backhoe. bucket according the instant application wherein there has been provided a device adapted to be included on backhoe buckets originating from a plurality of manufacturers which require no modification of the conventional support structure by which the reciprocating backhoe bucket has been traditionally supported, most particularly by a dipper stick and an associated bucket curl cylinder, both the stick and cylinder provided and adapted to engage both of two bucket brackets which carry and support the bucket itself. Appropriate connecting links extend from the bucket curl cylinder to each of the bucket brackets and defines a space therebetween which supports the housing of the instant application within which there is disposed a hydraulic motor suitably adapted to run from a conventional hydraulic power instrumentality commonly found on backhoe machines as is known in the prior art, the hydraulic motor cooperating through a train of gears to cause rotation of a shaft which extends between the connecting links to the bucket brackets and rotatably supports the bucket brackets thereon. The shaft is suitably contoured so that the area of support between the shaft and the bucket bracket experiences an oscillating motion by virtue of cam portions disposed on extremities of the associated shaft whereby the bucket brackets and the supported bucket oscillate about the shaft.

SUMMARY AND OBJECTS OF THE INVENTION

Thus, it is an object of the present invention to provide a new and novel vibrating device operatively associated with a backhoe bucket or the like which exhibits none of the drawbacks of known prior art techniques and increases the payload of the backhoe bucket without exposing the associated vibrating gear train to contamination by the construction work.

A further object of this invention contemplates providing a device as characterized above in which the conventional bracket and structure which is used to support the backhoe bucket from the associated dipper stick and bucket curl cylinder can occur without modification thereto.

A further object of this invention contemplates providing a device as characterized above which is readily adapted to be retrofitted on a plurality of backhoe buckets derived from different manufacturers without modification thereto.

A further object of this invention contemplates providing a device as characterized above in which the capacity of the bucket remains unchanged and therefor undiminished in volume.

A further object contemplates providing a device as set forth above in which the moving parts associated with the modification are held to a minimum.

A further object contemplates providing a device as set forth above in which the vibrating mechanism can be selectively energized so that if desired the bucket can be operated in a normal manner.

A still further object of this invention contemplates providing a device as set forth above in which the reciprocating motion caused by the apparatus can be energized at any time; that is during digging, unloading, and during all functions therebetween.

A further object contemplates providing a device as set forth above which is adapted to be powered by the on board motor of the associated backhoe.

A further object of this invention contemplates providing a device as characterized above which allows the bucket to be unloaded expeditiously and completely.

A further object contemplates providing a device as set forth above which can be installed and removed in a minimal amount of time.

A further object of this invention contemplates providing a device as set forth above which is extremely durable in construction, safe to use, and lends itself to mass production techniques thereby rendering the apparatus economically feasible.

These and other objects will be made manifest when considering the following detailed specification when taken in conjunction with the appended drawing figures wherein there has been provided a reciprocating backhoe bucket formed with and adapted to be modified for conventional backhoe buckets made available by a plurality of manufacturers. More particularly, the conventional dipper stick and associated bucket curl cylinder are allowed to fasten to the bucket brackets and an associated linkage in a substantially normal manner. The adjunct disposed below the bucket curl cyliner and between a pair of connecting links which operatively connect the bucket curl cylinder to a portion of the digging bucket via the bucket bracket includes an area extending therebetween defining a housing for a hydraulic motor to be operatively associated, the hydraulic motor having an output shaft and a bevelled gear driving a further shaft extending between the connecting links by virtue of a further bevelled gear disposed on the shaft, the shaft having first and second extremities provided with cam surfaces, each cam surface relatively in phase, one to the other, and oriented to condition a cam sleeve and bucket bracket bearing so as to provide and transfer to the bucket an oscillatory motion.

These and other objects will be made manifest when considering the following detailed specification when taken in conjunction with the appended drawing figures.

BRIEF DESCRIPTION OF THE DRAWING FIGURES

BRIEF DESCRIPTION OF THE PREFERRED EMBODIMENT

Figure 1:
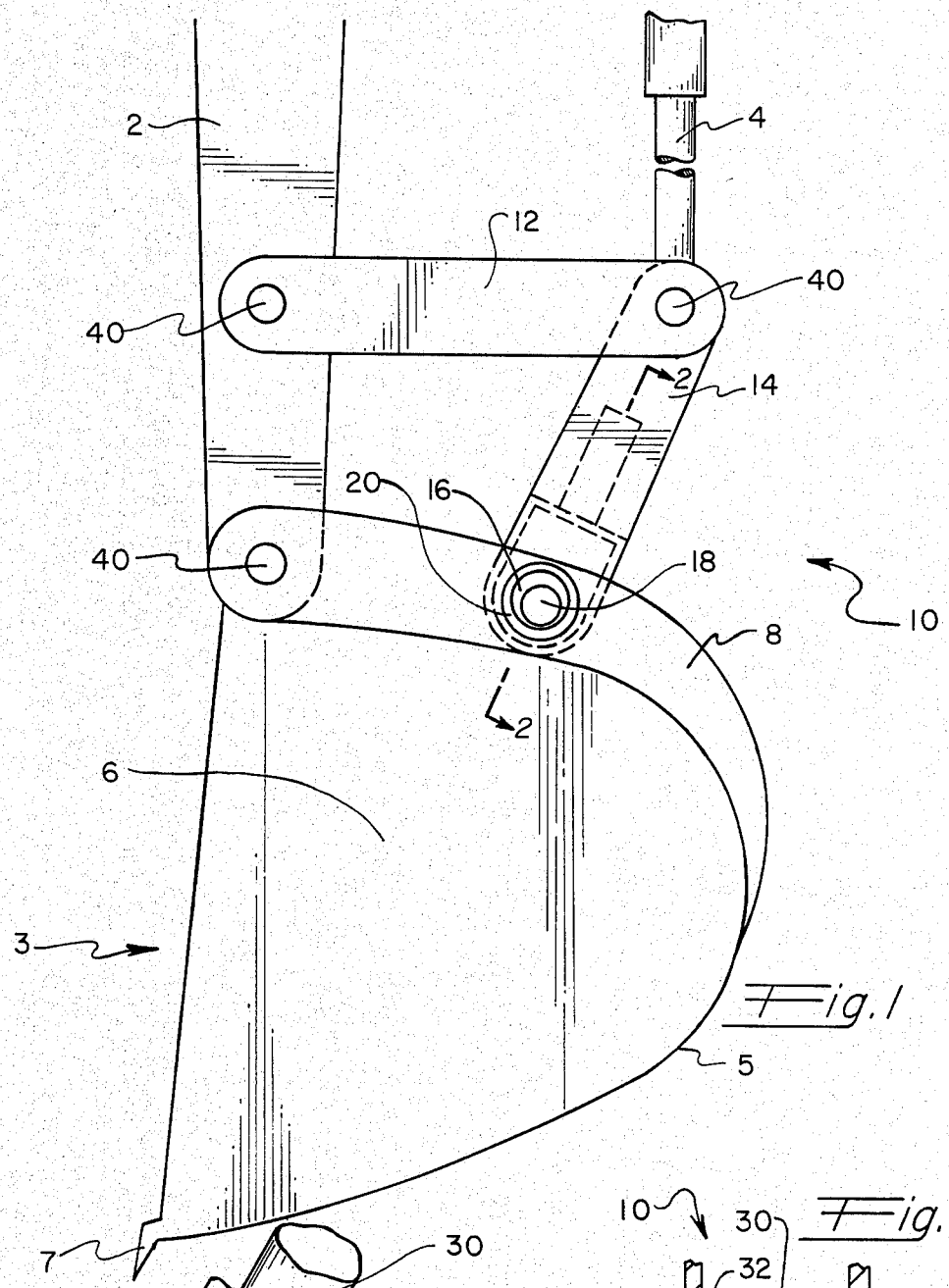
FIG. 1 is a side view of the conventional backhoe bucket according to known prior art, with the modified structure associated therewith shown in phantom and occluded by a connecting link.

Referring to the drawings now wherein like reference numerals refer to like parts throughout the various drawing figures, reference numeral 10 is directed to the reciprocating backhoe bucket according to the present invention.

The reciprocating backhoe bucket 10 includes a conventional dipper stick 2 which extends from the machine proper to the bucket and is connected to a pair of bucket brackets 8 which includes a transverse pivot shaft 40.

Thus, the dipper stick 2 may be in the form of a downwardly extending tapered rod through which the pivot shaft 40 extends and thereby constrains the bucket bracket 8 along one axis of rotation as is known in the prior art.

As shown in FIG. 1 each bucket bracket 8 has a widened portion immediately surrounding the pivot shaft 40 and tapers to the rear of the bucket in an arcuate configuration and terminates in a point. The bucket itself is of arcuate configuration having a top surface complemental to the bottom surface of the bucket brackets, and the reciprocating bucket includes first and second sidewalls 6, an arcuate endwall 5 which is attached to the bucket bracket 8 and an open face 3 which is adapted to receive therewithin the excavation. The intersection between the lowermost portion of the open face and a lowermost portion of the endwall 5 defines a downwardly and forwardly declinated digging edge 7 that runs the length of the bucket. Thus, vibration of the entire bucket provides an associated vibration of not only the digging edge but also the interior of the bucket to assist in loading and unloading thereof.

The dipper stick 2 has a further pivot shaft 40 located up from the tapered terminal portion of the dipper stick which is adjacent the bucket brackets 8 and the further pivot shaft 40 pivotally supports a pair of spaced transverse links 12 only one of which is shown in FIG. 1. A terminus of the transverse link 12 remote from its pivotal connection to pivot to the dipper stick 2 through pivot shaft 40 includes a further pivot shaft 40 which connects to a terminus of the bucket curl cylinder and piston 4 shown in FIG. 1. Thus, extension and contraction of the bucket curl piston in relationship to its associated cylinder causes arcuate motion of the transverse link 12 about the dipper stick upper pivot 40.

The same end of the bucket curl cylinder and piston 4 is connected to a further area of the bucket bracket 8 by means of connector links 14 which extends from the transverse links pivot shaft 40 remote from the dipper stick 2, the connecting link 14 extending directly between the terminus of the connecting link 12 and the bucket bracket 8. Thus, extension and contraction of the bucket curl cylinder provides a direct line of force on the bucket bracket 8 and therefor the associated bucket to pivot around the lower dipper stick pivot shaft as should be clear.

Figure 2:
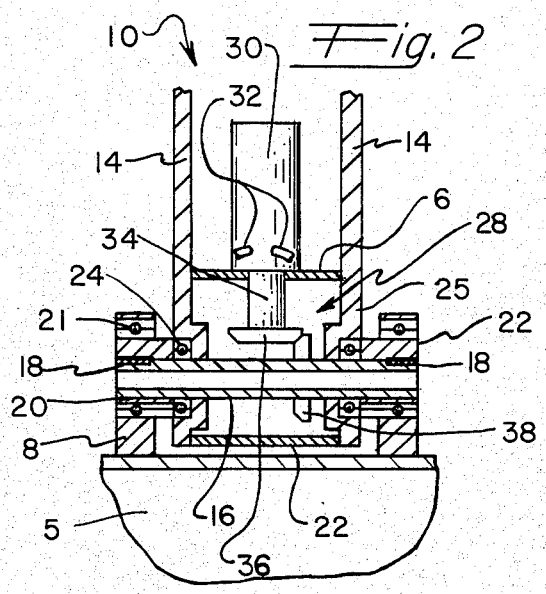
FIG. 2 is a sectional view taken along lines 2—2 of FIG. 1 showing the invention.
Figure 3:
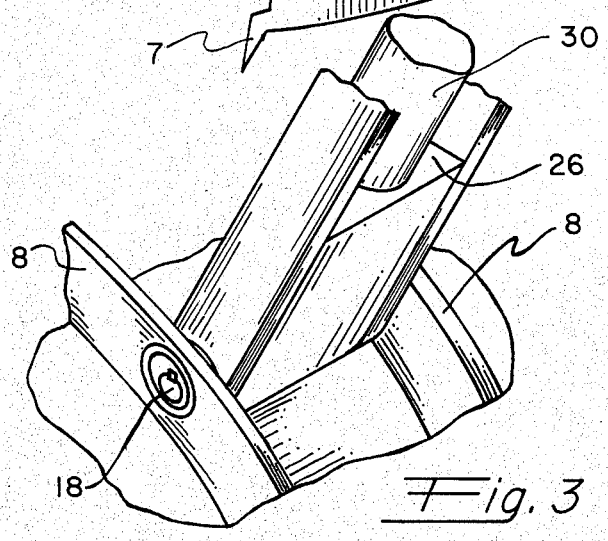
FIG. 3 is a perspective view of the shaft and cam surfaces according to the instant invention.

As shown in FIG. 2, the pair of connecting links 14 connect to the pair of bucket brackets 8 in the following manner.

Extending between the bucket bracket 8 and the connecting links 14 are in order, a pair of cam sleeves and overlying bucket bracket bearings 21 which communicate in turn with a connecting link and shaft bearings 24. More particularly, a shaft 16 extends between the connecting links 14 and the bucket brackets 8, and it is to be noted as shown in FIG. 2 that the shaft 16 has two ends both of which are provided with cam surfaces 20 relative to each other in the same phase. Thus, rotation of the shaft 16 will provide no relative motion to the connecting links 14, but will cause the bucket bracket 8 to oscillate and therefore the bucket.

Thus, it should be clear that the extent of the cam surfaces 20 along the longitudinal periphery of the shaft is of sufficient magnitude that it exceeds the width of the bearing 21 of the associated bucket bracket 8, but the cam surface 20 is not extensive enough to contact and influence the bearings 24 associated with the connecting link 14, and that the shaft 16 is of uniform radius. In rotation of the shaft therefor, the amount of play experienced by the bearing 21 in its rotational connection with the cam surface 20 imparts the vibratory motion to the bucket bracket 8. As shown, each cam 20 is connected to shaft 16 by means of a key 18.

The shaft 16 is shown in FIG. 2 as being rotated through a shaft bevel gear 38 operatively connected to a hydraulic motor bevel gear 36, the hydraulic motor bevel gear 36 extending from a hydraulic motor 30 and connected thereto by a hydraulic output shaft 34. Hydraulic lines 32 extend from the hydraulic motor to a source of hydraulic power commonly found on all backhoe type equipment. The hydraulic output shaft 34 and the pair of bevelled gears oriented ninety degrees one from the other are incapsulated in a housing, which, as shown in FIG. 2, has one wall removed for clarity in exposing the interior, but includes a bottom wall 22, a top wall 26, and a rear wall 25 with a front wall (not shown) all walls and connecting links defining an interior 28.

In use and operation, the hydraulic motor is selectively energized either when the backhoe bucket is being filled or emptied, for example, and rotation of the hydraulic motor causes the bevel gears 36, 38 to impart rotation to the shaft 16. The bearings 24 extending between the shaft 16 and the connecting links 14 smoothly and rotatably support the shaft therein, but the play associated with the ends of the shaft 16 which define cam surfaces 20 encourage the bearings 21 disposed on the bucket bracket 8 to impart oscillatory motion to the bucket 5,6 through the bracket 8 from the cam 20.

Moreover, having thus described the invention, it should be apparent that numerous structural modifications are contemplated as being a part of this invention as set forth hereinabove and as defined hereinbelow by the claims.

What is claimed is:

1. A reciprocating device for a backhoe bucket which includes a downwardly extending dipper stick having respective ends pivotally connected and supporting an associated pair of bucket brackets, the bucket brackets having a contour complemental to an end wall of the bucket to support same, and a bucket curl cylinder and piston connected to the dipper stick by means of transverse links, similarly pivoted, and a pair of connecting links extending from the intersection of the bucket curl cylinder/piston and the transverse link to a further area on the bucket bracket, the reciprocating device including:

shaft means being the connection between the connecting links and the bucket brackets, said shaft means rotatably supported by the connecting links by a bearing means and provided with means for rotating said shaft, said rotating means encased in a housing disposed between said pair of connecting links, and cam means associated with said shaft means and connecting the connecting links to the bucket brackets, whereby rotation of said shaft means imparts reciprocal oscillating motion to the bucket bracket and therefor the backhoe bucket.

2. The reciprocating device of claim 1 wherein said cam means of said shaft connects to the bucket brackets through further bearings.

3. The device of claim 2 wherein said means for rotating said shaft include a hydraulic motor mounted adjacent the connecting links and having an output shaft provided with a bevel gear which communicates with a bevel gear fixed on said shaft means.

* * * * *